US012808062B2

(12) United States Patent
Kawai

(10) Patent No.: US 12,808,062 B2
(45) Date of Patent: Nov. 24, 2026

(54) WATER ELECTROLYSIS SYSTEM

(71) Applicant: TOYOTA JIDOSHA KABUSHIKI KAISHA, Toyota (JP)

(72) Inventor: Hiroyuki Kawai, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 574 days.

(21) Appl. No.: 18/468,354

(22) Filed: Sep. 15, 2023

(65) Prior Publication Data

US 2024/0167167 A1 May 23, 2024

(30) Foreign Application Priority Data

Nov. 18, 2022 (JP) ..... 2022-184903

(51) Int. Cl.

| | |
|---|---|
| ***C25B 1/04*** | (2021.01) |
| ***C25B 9/17*** | (2021.01) |
| ***C25B 15/02*** | (2021.01) |
| ***C25B 15/021*** | (2021.01) |
| ***C25B 15/027*** | (2021.01) |
| ***C25B 15/08*** | (2006.01) |

(52) U.S. Cl.

CPC ..... *C25B 1/04* (2013.01); *C25B 9/17* (2021.01); *C25B 15/02* (2013.01); *C25B 15/021* (2021.01); *C25B 15/027* (2021.01); *C25B 15/08* (2013.01)

(58) Field of Classification Search

CPC ..... C25B 1/04; C25B 15/02; C25B 15/08; C25B 15/025; C25B 15/027

See application file for complete search history.

(56) References Cited

U.S. PATENT DOCUMENTS

| | | | | |
|---|---|---|---|---|
| 2011/0081586 | A1* | 4/2011 | McAlister | H01M 8/186 429/422 |
| 2016/0108528 | A1* | 4/2016 | Lin | A61M 16/14 204/278 |
| 2022/0106695 | A1* | 4/2022 | Uchino | C25B 15/02 |

FOREIGN PATENT DOCUMENTS

| | | |
|---|---|---|
| JP | 2010-280975 A | 12/2010 |

* cited by examiner

*Primary Examiner* — Brian W Cohen
(74) *Attorney, Agent, or Firm* — SoraIP, Inc.

(57) ABSTRACT

A water electrolysis system comprising: a water electrolysis device that performs electrolysis of water; a water supply device that supplies water to the water electrolysis device; a power supply that supplies a current to the water electrolysis device; and a control device that adjusts a water flow amount of water supplied from the water supply device to the water electrolysis device, wherein the control device reduces a water flow amount of water supplied from the water supply device to the water electrolysis device when the value X is 1.3 or more, where X is a product of a current density ($A/cm^2$) of the current supplied to the water electrolysis device and a viscosity (mPa·s) of water supplied to the water electrolysis device.

5 Claims, 3 Drawing Sheets

WATER ELECTROLYSIS SYSTEM

CROSS-REFERENCE TO RELATED APPLICATION

This application claims priority to Japanese Patent Application No. 2022-184903 filed on Nov. 18, 2022 incorporated herein by reference in its entirety.

BACKGROUND

1. Technical Field

The present application relates to a water electrolysis system.

2. Description of Related Art

In recent years, hydrogen has attracted attention as a carbon dioxide-free energy source. As a method for producing hydrogen, there are methods such as alkaline water electrolysis and water electrolysis. Among them, the water electrolysis has attracted attention because of its high efficiency.

Japanese Unexamined Patent Application Publication No. 2010-280975 (JP 2010-280975 A) discloses the following configuration regarding the water electrolysis system. In other words, JP 2010-280975 A discloses a water electrolysis system including a water electrolysis device that electrolyzes water to generate hydrogen gas, a power supply device that supplies electric power obtained by natural energy to the water electrolysis device, a water supply device that supplies water to the water electrolysis device, and a control device that adjusts a water supply amount by the water supply device in accordance with electric power supplied from the power supply device to the water electrolysis device.

SUMMARY

In the water electrolysis system according to JP 2010-280975 A, a water supply amount is adjusted according to electric power by a control device. For example, when the electric power increases, the water supply amount is increased, and conversely, when the electric power decreases, the water supply amount is reduced. This is because the amount of water required for water electrolysis increases as the electric power becomes higher.

On the other hand, the present inventors have found that, when an amount of flow of water in a high current density region (high power region) is increased, the water electrolysis reaction efficiency decreases as opposed to the conventional common knowledge.

In view of the above circumstances, an object of the present disclosure is to provide a water electrolysis system capable of improving the water electrolysis reaction efficiency.

The present disclosure provides a water electrolysis system as one aspect for solving the above issue, and the water electrolysis system includes:

- a water electrolysis device for performing water electrolysis;
- a water supply device for supplying water to the water electrolysis device;
- a power supply for supplying a current to the water electrolysis device; and

- a control device for adjusting an amount of flow of water supplied from the water supply device to the water electrolysis device.

When a product of current density ($A/cm^2$) of the current supplied to the water electrolysis device and viscosity (mPa·s) of the water supplied to the water electrolysis device is a value X, and the value X is 1.3 or more, the control device reduces the amount of flow of water supplied from the water supply device to the water electrolysis device.

In the above water electrolysis system, the control device may reduce the amount of flow of water supplied from the water supply device to the water electrolysis device to 50% or more and 85% or less when the value X is 1.3 or more and less than 2.0, and may reduce the amount of flow of water supplied from the water supply device to the water electrolysis device to 33% or more and 90% or less when the value X is 2.0 or more.

With the water electrolysis system according to the present disclosure, it is possible to improve the water electrolysis reaction efficiency in the high current density region. In addition, in the high current density region, the water electrolysis reaction efficiency can be improved by reducing the amount of flow of water, so that a large water supply device is not required.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
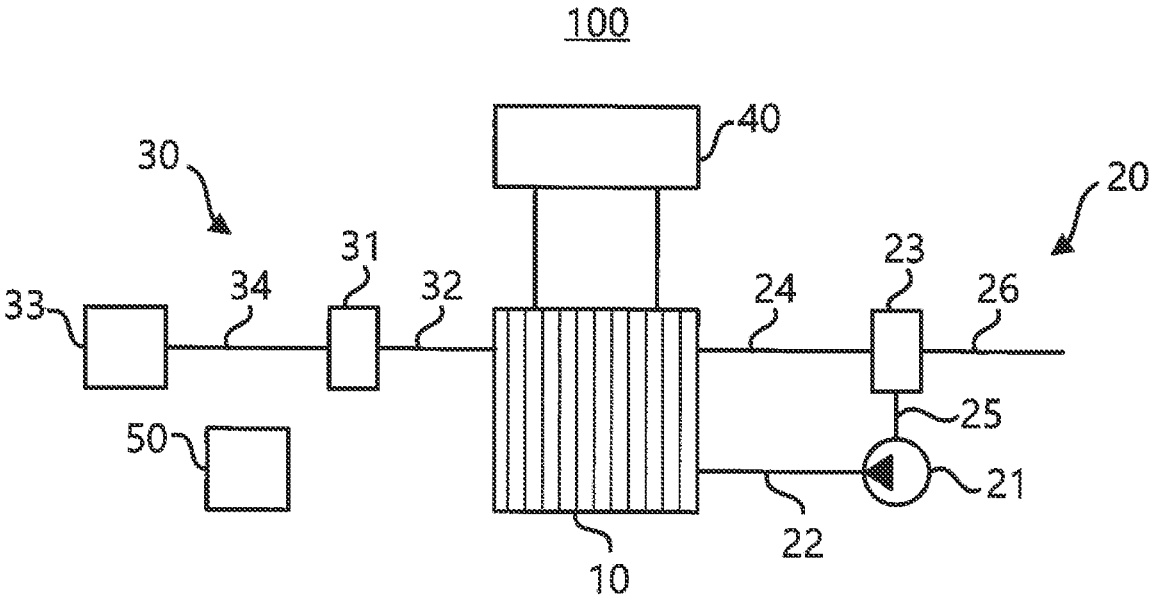
FIG. 1 is a block diagram of a water electrolysis system 100.

The water electrolysis system of the present disclosure will be described with reference to the water electrolysis system 100 which is an embodiment. FIG. 1 shows a block diagram of a water electrolysis system 100.

The water electrolysis system 100 includes a water electrolysis device 10, an oxygen electrode side pipe portion 20 disposed on the oxygen electrode side of the water electrolysis device 10, a hydrogen electrode side pipe portion 30 disposed on the hydrogen electrode side of the water electrolysis cell, a power supply 40 for supplying a current to the water electrolysis device, and a control device 50.

Water Electrolysis Device 10

The water electrolysis device 10 is a device for performing water electrolysis. The configuration of the water electrolysis device 10 is known. Hereinafter, an example of the water electrolysis device 10 will be described.

The water electrolysis device 10 includes a water electrolysis cell. Typically, the water electrolysis device 10 includes a water electrolysis stack in which a plurality of water electrolysis cells is stacked. The water electrolysis cell includes a terminal connectable to the power supply 40.

The water electrolysis cell is a device for electrolyzing water and generating hydrogen and oxygen. The water electrolysis cell has an oxygen electrode and a hydrogen electrode. In the water electrolysis cell, water is supplied to the oxygen electrode of the water electrolysis cell and a voltage is applied to generate oxygen from the oxygen electrode and hydrogen from the hydrogen electrode. The type of the water electrolysis cell is not particularly limited, but a Polymer Electrolyte Membrane (PEM) type water electrolysis cell may be employed from the viewpoint of improving the water electrolysis efficiency. Hereinafter, the configuration of PEM type water electrolysis cell will be briefly described.

PEM type water electrolysis cell includes a membrane electrode assembly and a pair of separators disposed on both surfaces of the membrane electrode assembly.

The membrane electrode assembly includes an electrolyte layer, an oxygen electrode catalyst layer disposed on one surface of the electrolyte layer, and a hydrogen electrode catalyst layer disposed on the other surface of the electrolyte layer.

The electrolyte layer is not particularly limited as long as it has proton conductivity. Examples include proton-conducting polymers. Examples of the proton conductive polymer include a proton conductive polymer having a sulfonic acid group such as a perfluoroalkylsulfonic acid polymer.

The oxygen electrode catalyst layer includes an oxygen electrode catalyst capable of generating oxygen by water electrolysis. The oxygen electrode catalyst is not particularly limited, and examples thereof include metal catalysts. Examples of the metal catalyst include a metal catalyst containing Pt. Ru, Rh, Os, Ir, Pd, or Au. The metal catalyst may be an oxide of these metals.

The hydrogen electrode catalyst layer includes a hydrogen electrode catalyst capable of generating hydrogen by water electrolysis. The hydrogen electrode catalyst is not particularly limited, and examples thereof include a metal catalyst. Examples of the metal catalyst include a metal catalyst containing Pt. Ru, Rh, Os, Ir, Pd, or Au. The metal catalyst may be an oxide of these metals. The hydrogen electrode catalyst may be an electrically conductive support (metal supported catalyst) on which a metal catalyst is supported.

The separators are disposed on both surfaces of the membrane electrode assembly. The separator is formed from a conductive member. For example, a resin containing a carbon material; and a metal material such as iron, copper, stainless steel, or titanium. A predetermined flow path is formed on the surface of the separator on the catalyst layer side, and the flow path has a role of guiding water supplied to the water electrolysis cell, oxygen generated by the water electrolysis reaction, or hydrogen.

Oxygen Electrode Side Pipe Portion 20

The oxygen electrode side pipe portion 20 serves to supply water to the oxygen electrode of the water electrolysis device 10. As illustrated in FIG. 1, the oxygen electrode side pipe portion 20 includes a water supply device 21, a water supply flow path 22, an oxygen electrode side gas-liquid separator 23, a water discharge flow path 24, a circulation flow path 25, and a discharge flow path 26.

The water supply device 21 is a device that supplies water to the oxygen electrode of the water electrolysis device 10. In order to circulate the water, pressure may be applied to supply the water to the water electrolysis device 10. Examples of the water supply device 21 include a pump.

The water supply flow path 22 is a pipe for connecting the water electrolysis device 10 and the water supply device 21 and allowing the water supplied from the water supply device 21 to flow.

The oxygen electrode-side gas-liquid separator 23 separates water and oxygen discharged from the oxygen electrode of the water electrolysis device 10. The water separated by the oxygen electrode-side gas-liquid separator 23 is sent to the water supply device 21 via the circulation flow path 25, and is reused in the water electrolysis reaction. The oxygen separated by the oxygen electrode-side gas-liquid separator 23 is discharged to the outside via the discharge flow path 26.

The water discharge flow path 24 connects the water electrolysis device 10 and the oxygen electrode-side gas-liquid separator 23, and is a pipe for flowing water and oxygen discharged from the oxygen electrode of the water electrolysis device 10.

The circulation flow path 25 is a pipe for connecting the water supply device 21 and the oxygen electrode-side gas-liquid separator 23 and allowing the water discharged from the oxygen electrode-side gas-liquid separator 23 to flow. The circulation flow path 25 is used in a case where water is circulated in the oxygen electrode side pipe portion 20, and therefore is not necessary in a case where water is not circulated.

The discharge flow path 26 is connected to the oxygen electrode-side gas-liquid separator 23, and is a pipe for flowing the oxygen separated by the oxygen electrode-side gas-liquid separator 23.

Hydrogen Electrode Side Pipe Portion 30

The hydrogen electrode side pipe portion 30 serves to recover hydrogen generated in the hydrogen electrode of the water electrolysis device 10. As illustrated in FIG. 1, the hydrogen electrode side pipe portion 30 includes a hydrogen electrode-side gas-liquid separator 31, a hydrogen discharge flow path 32, a hydrogen tank 33, and a hydrogen supply flow path 34.

The hydrogen electrode-side gas-liquid separator 31 separates water and hydrogen discharged from the hydrogen electrode of the water electrolysis device 10. As described above, water is supplied to the oxygen electrode of the water electrolysis device 10, but water may permeate through the membrane electrode assembly and leak to the hydrogen electrode side. Therefore, a gas-liquid separator is also provided in the hydrogen electrode side pipe portion 30. The hydrogen separated by the hydrogen electrode-side gas-liquid separator 31 is sent to the hydrogen tank 33 via the hydrogen supply flow path 34. The water separated by the hydrogen electrode-side gas-liquid separator 31 is discharged as appropriate.

The hydrogen discharge flow path 32 connects the water electrolysis device 10 and the hydrogen electrode-side gas-liquid separator 31, and is a pipe for flowing water and hydrogen discharged from the hydrogen electrode of the water electrolysis device 10.

The hydrogen tank 33 is for storing hydrogen separated by the hydrogen electrode-side gas-liquid separator 31.

The hydrogen supply flow path 34 is a pipe for connecting the hydrogen electrode-side gas-liquid separator 31 and the hydrogen tank 33 to flow the hydrogen separated by the hydrogen electrode-side gas-liquid separator 31.

Power Supply 40

The power supply 40 is for supplying a current to the water electrolysis device 10. The power supply 40 is connected to both the oxygen electrode and the hydrogen electrode of the water electrolysis device 10. Such a power supply 40 is known. The water electrolysis is generated by supplying water to the water electrolysis device 10 while a current is supplied by the power supply 40.

Control Device 50

The control device 50 is a computer system including a CPU, RAM, input/output interfaces, and the like. The control device 50 adjusts the amount of water supplied from the water supply device 21 to the water electrolysis device 10. Specifically, when the product of the current density ($A/cm^2$) of the current supplied to the water electrolysis device 10 and the viscosity (mPa·s) of the water supplied to the water electrolysis device 10 is defined as a value X (=[current density]×[viscosity of water]), the control device 50 performs control to reduce the amount of water supplied from the water supply device 21 to the water electrolysis device 10 when the value X is 1.3 or more.

Figure 2:
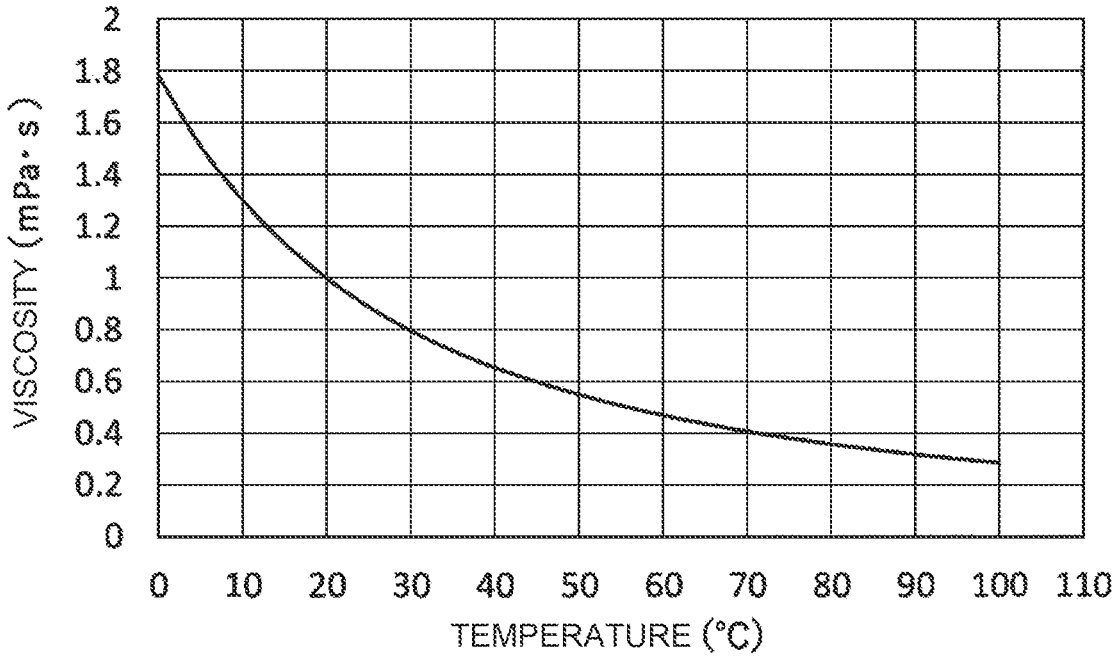
FIG. 2 is a graph showing the relationship between the temperature and the viscosity of water.
Figure 3:
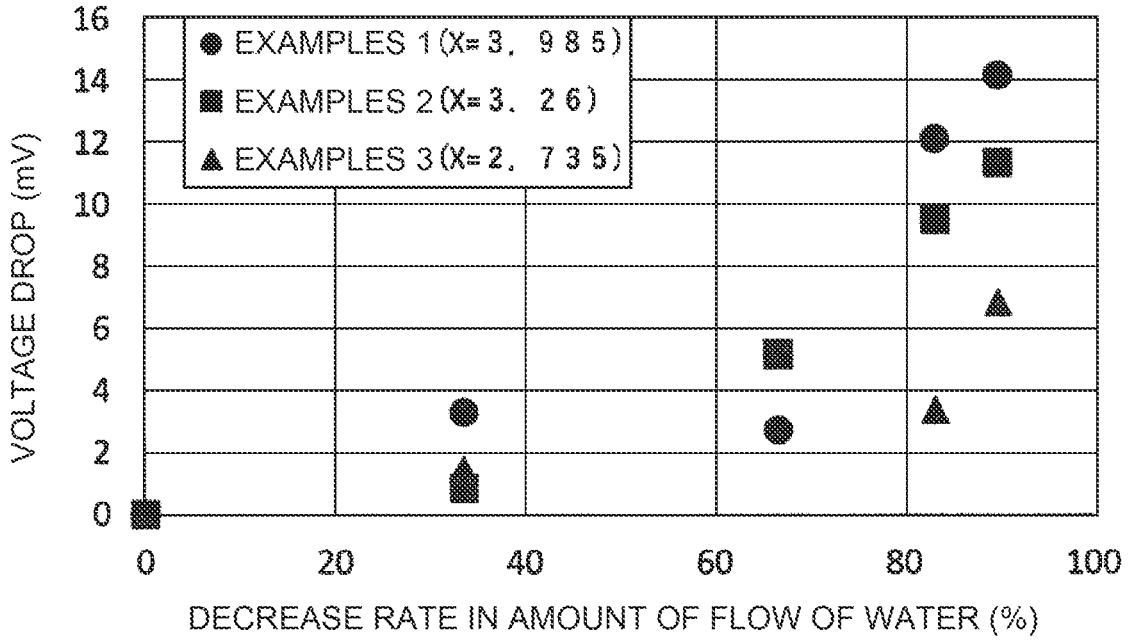
FIG. 3 is the results of Examples 1-3.
Figure 4:
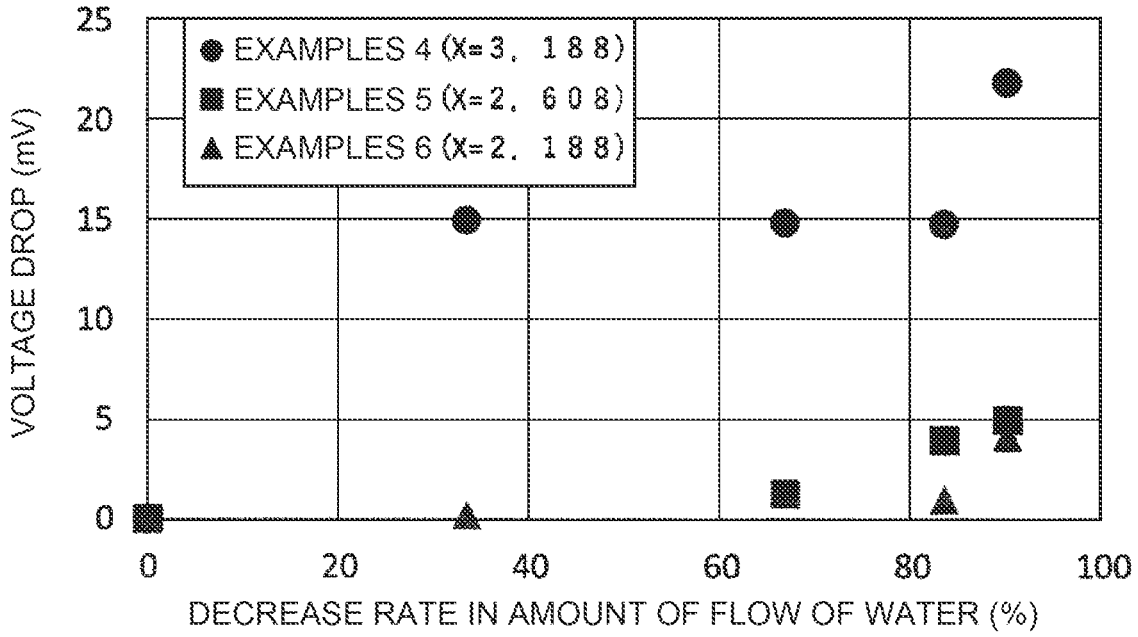
FIG. 4 is the results of Examples 4-6.
Figure 5:
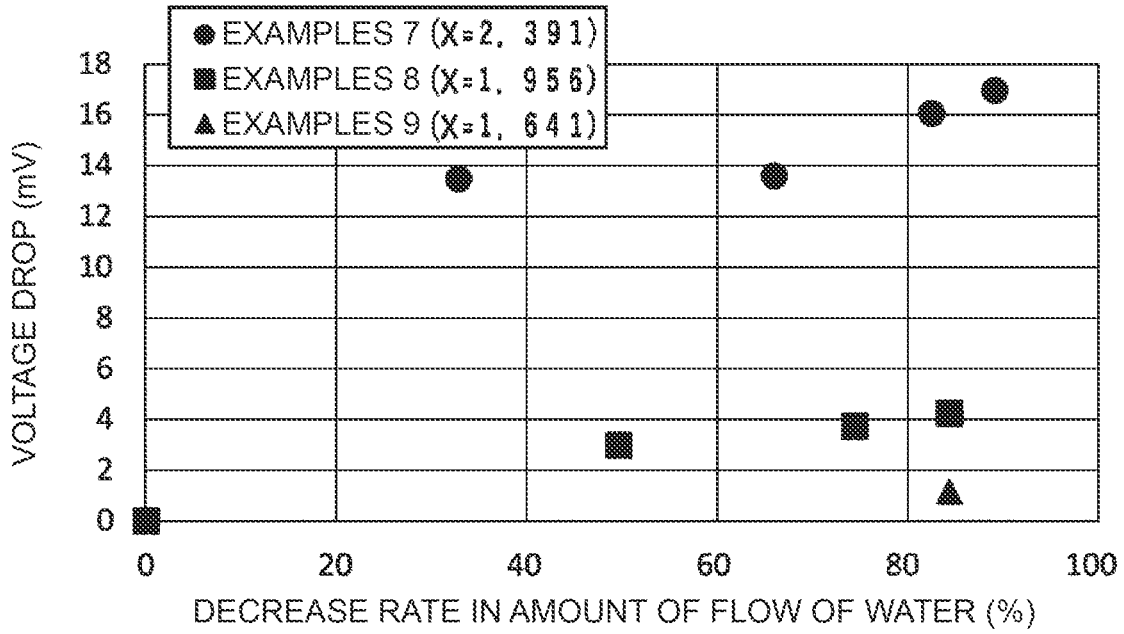
FIG. 5: Results of Examples 7-9.
Figure 6:
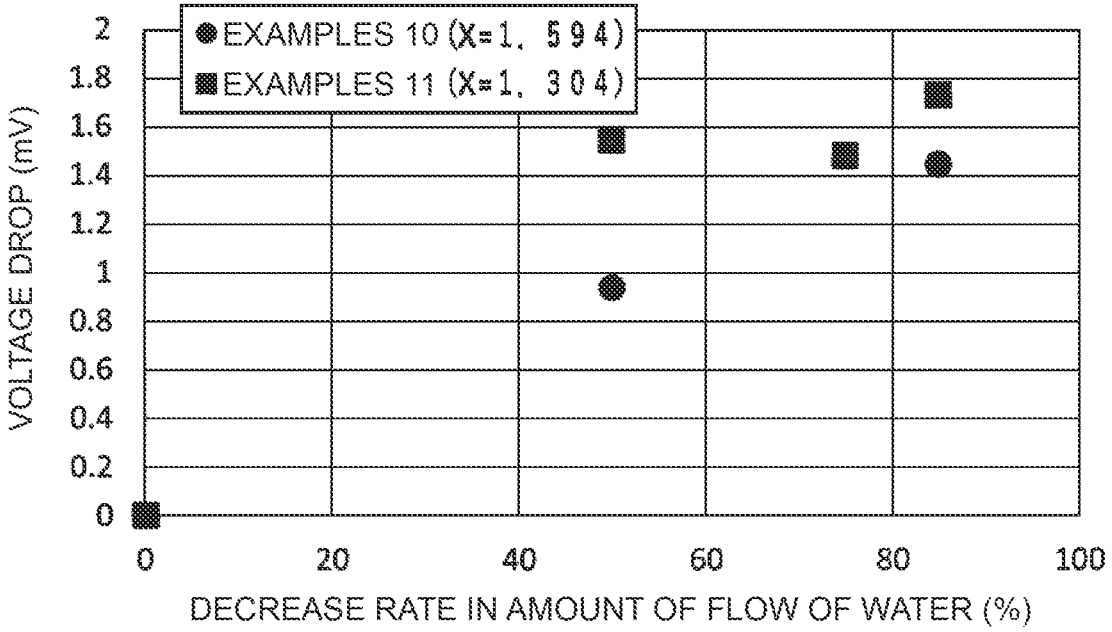
FIG. 6 shows the results of Examples 10-11.

The current density ($A/cm^2$) of the current supplied to the water electrolysis device 10 can be measured by a current measuring device provided in the power supply 40. The viscosity (mPa·s) of the water supplied to the water electrolysis device 10 can be calculated from the relation between the temperature and the viscosity of the water. For reference, FIG. 2 shows the relationship between the temperature and viscosity of water. As the temperature of the water, the temperature of the water supplied to the oxygen electrode of the water electrolysis device 10, the temperature of the water discharged from the oxygen electrode, or an average value of these temperatures can be used. The temperature measurement of the water can be performed, for example, by providing a temperature measuring device at a position close to the water electrolysis device 10 in the water supply flow path 22 and/or the water discharge channel 24.

The reference amount of the water flow amount (the water flow amount before reduction) of the water supplied to the water electrolysis device 10 is typically adjusted so as to obtain the target current density. The water electrolysis reaction occurring on the oxygen electrode side is as follows.

$$2H_2O \rightarrow O_2 + 4H^+ + 4e^-$$

From the above formula, the stoichiometric value (stoichiometric ratio=1) of the water flow rate is determined according to the stoichiometric ratio. However, in practice, the theoretical value of the amount of water flow does not provide the desired current density. Typically, an excess of water is supplied. For example, the flow rate is a stoichiometric ratio of 50 to 100 times the flow rate (theoretical value) at which the target current density is obtained. This is used as the reference amount. However, the reference amount is not limited to this, and is appropriately determined based on the configuration of the water electrolysis device 10 and the water electrolysis system 100.

As described above, the control device 50 reduces the amount of water supplied from the water supply device 21 to the water electrolysis device 10 when the value X, which is the product of the "current density" and the "viscosity of water", is 1.3 or more. A value X of 1.3 or more means a high current density region. A decrease in the amount of water flow means that the amount of water flow is reduced from the reference amount based on the stoichiometric ratio. That is, the rate of decrease in the amount of water flow can be referred to as the rate of decrease in the stoichiometric ratio. As described above, the water electrolysis system 100 can improve the water electrolysis reaction efficiency by reducing the amount of water passing in accordance with the above-described conditions. In addition, since the water electrolysis reaction efficiency can be improved by reducing the amount of water passing, a large-sized water supply device 21 is not required.

From the viewpoint of further improving the water electrolysis reaction efficiency, the amount of water supplied from the water supply device 21 to the water electrolysis device 10 may be reduced to 50% or more and 85% or less when the value X is 1.3 or more and less than 2.0. In addition, when the value X is 2.0 or more, the water flow amount may be reduced to 33% or more and 90% or less, and from the viewpoint of improving the water electrolysis reaction efficiency, the water flow amount may be reduced to 66% or more and 90% or less.

The estimation mechanism is as follows. First, in the low current density region, the amount of oxygen discharged (the amount of bubbles) is small, and the permeation of the liquid water into the membrane electrode assembly is dominant, so that when the amount of water passing is increased, the voltage is lowered and the water electrolysis reaction efficiency is improved. On the other hand, in the high current density region, the discharge of bubbles is rate-limiting, and when the amount of water passing is increased in this state, the flow path in the water electrolysis cell is filled with liquid water, the liquid water pressure rises, and the movement of the gas from the membrane electrode assembly including the catalyst layer of the water electrolysis reaction to the flow path and the movement of the water from the flow path to the membrane electrode assembly are restricted. Therefore, the water electrolysis reaction efficiency is lowered. Further, it is considered that this tendency becomes more remarkable when the temperature of water is lowered in this state. This is because lowering the temperature of the water would significantly increase the viscosity of the water, which would negatively affect the permeation of the liquid water and the discharge of the bubbles.

Therefore, the inventors focused on "current density" and "viscosity of water", which are factors that greatly affect the mechanism, and proceeded with the experiment. Then, it was found that the water electrolysis reaction efficiency can be improved by reducing the amount of water passing when the value X which is the product of the "current density" and the "viscosity of water" is 1.3 or more. The water electrolysis system 100 has been invented based on the above findings.

The water electrolysis system of the present disclosure has been described above with reference to one embodiment. With the water electrolysis system according to the present disclosure, it is possible to improve the water electrolysis reaction efficiency in the high current density region. In addition, in the high current density region, the water electrolysis reaction efficiency can be improved by reducing the amount of flow of water, so that a large water supply device is not required.

Hereinafter, the present disclosure will be further described with reference to Examples.

A water electrolysis system was constructed according to FIG. 1. Then, focusing on the value X which is the product of "current density" and "viscosity of water", the relationship between the decrease rate of the water flow rate and the voltage drop amount was studied. The results are shown in Tables 1 to 4 and FIGS. 3 to 6. The reduction rate of the water flow rate is based on the stoichiometric ratio, and the reduction rate of 100% means a theoretical value (stoichiometric ratio=1) of the water flow rate in which the target current density is obtained. The voltage drop amount means that the higher the value, the higher the water electrolysis reaction efficiency.

TABLE 1

| Example 1 (X = 3.985) | | Example 2 (X = 3.26) | | Example 3 (X = 2.735) | |
|---|---|---|---|---|---|
| Decrease rate in amount of flow of water (%) | Voltage drop (mV) | Decrease rate in amount of flow of water (%) | Voltage drop (mV) | Decrease rate in amount of flow of water (%) | Voltage drop (mV) |
| 90 | 14.2 | 90 | 11.4 | 90 | 6.9 |
| 83.4 | 12.1 | 83.4 | 9.5 | 83.4 | 3.4 |
| 66.8 | 2.7 | 66.8 | 5.2 | 66.8 | 5.1 |
| 33.6 | 3.3 | 33.6 | 0.9 | 33.6 | 1.5 |
| 0 | 0 | 0 | 0 | 0 | 0 |

TABLE 2

| Example 4 (X = 3.188) | | Example 5 (X = 2.608) | | Example 6 (X = 2.188) | |
|---|---|---|---|---|---|
| Decrease rate in amount of flow of water (%) | Voltage drop (mV) | Decrease rate in amount of flow of water (%) | Voltage drop (mV) | Decrease rate in amount of flow of water (%) | Voltage drop (mV) |
| 90 | 21.9 | 90 | 5.0 | 90 | 4.1 |
| 83.3 | 14.8 | 83.3 | 4.0 | 83.3 | 1.0 |
| 66.7 | 14.9 | 66.7 | 1.3 | 66.7 | 1.5 |
| 33.3 | 15.0 | — | — | 33.3 | 0.2 |
| 0 | 0 | 0 | 0 | 0 | 0 |

TABLE 3

| Example 7 (X = 2.391) | | Example 8 (X = 1.956) | | Example 9 (X = 1.641) | |
|---|---|---|---|---|---|
| Decrease rate in amount of flow of water (%) | Voltage drop (mV) | Decrease rate in amount of flow of water (%) | Voltage drop (mV) | Decrease rate in amount of flow of water (%) | Voltage drop (mV) |
| 90 | 16.9 | — | — | — | — |
| 83.3 | 16.0 | 85.0 | 4.2 | 85.0 | 1.2 |
| 66.6 | 13.6 | 75 | 3.7 | — | — |
| 33.2 | 13.5 | 50 | 3.0 | — | — |
| 0 | 0 | 0 | 0 | 0 | 0 |

TABLE 4

| Example 10 (X = 1.594) | | Example 11 (X = 1.304) | |
|---|---|---|---|
| Decrease rate in amount of flow of water (%) | Voltage drop (mV) | Decrease rate in amount of flow of water (%) | Voltage drop (mV) |
| 85.0 | 1.4 | 85.0 | 1.7 |
| — | — | 75 | 1.5 |
| 50 | 0.9 | 50 | 1.5 |
| 0 | 0 | 0 | 0 |

From the results of Examples 1 to 7, by decreasing the amount of water flow to 33% or more and 90% or less when the value X is 2.0 or more, the amount of voltage drop tends to increase, by decreasing the amount of water flow to 66% or more and 90% or less, further voltage drop tends to increase. Further, from the result of Example 8 to 11, by reducing the water flow rate when the value X is less than 1.3 to 2.0 to 50% to 85% or less, the amount of the decrease in the voltage tended to increase.

From the above, it is considered that the voltage drop amount increases by decreasing the water flow amount when the value X is 1.3 or more. Therefore, it is considered that the water electrolysis reaction efficiency is improved by decreasing the water flow rate when the value X is 1.3 or more.

What is claimed is:

1. A water electrolysis system comprising:

a water electrolysis device configured to perform water electrolysis, the water electrolysis device including an oxygen electrode;

an oxygen electrode-side gas-liquid separator configured to separate water and oxygen discharged from the oxygen electrode;

a water supply device configured to supply water to the water electrolysis device;

a water supply flow path connecting the water electrolysis device and the water supply device;

a water discharge flow path connecting the water electrolysis device and the oxygen electrode-side gas-liquid separator;

a power supply configured to supply a current to the water electrolysis device, the power supply including a current measuring device configured to measure current density ($A/cm^2$) of the current supplied to the water electrolysis device;

a first temperature measuring device provided at a position within a predetermined distance from the water supply flow path and configured to measure a first temperature that is a temperature of water supplied to the oxygen electrode;

a second temperature measuring device provided at a position within a predetermined distance from the water discharge flow path and configured to measure a second temperature that is a temperature of water discharged from the oxygen electrode; and a control device configured to adjust an amount of flow of water supplied from the water supply device to the water electrolysis device, wherein in a case where a product of current density ($A/cm^2$) of the current supplied to the water electrolysis device and viscosity (mPa·s) of the water supplied to the water electrolysis device is a value X, and the value X is 1.3 or more, the control device is further configured to reduce the amount of the flow of water to a predetermined ratio of a reference amount of the flow of water, the viscosity being calculated based on a third temperature, the third temperature being an average of the first temperature and the second temperature, the reference amount being calculated by multiplying a stoichiometric value of the amount of the flow of water by a predetermined factor, and the stoichiometric value being determined according to a stoichiometric ratio calculated from a water electrolysis reaction occurring on a side of the oxygen electrode.

2. The water electrolysis system according to claim 1, wherein the control device is further configured to:

reduce the amount of the flow of water to 50% or more and 85% or less of the reference amount in a case where the value X is 1.3 or more and less than 2.0; and reduce the amount of the flow of water to 33% or more and 90% or less of the reference amount in a case where the value X is 2.0 or more.

3. The water electrolysis system according to claim 1, wherein the predetermined factor is equal to or more than 50 and equal to or less than 100.

4. The water electrolysis system according to claim 2, wherein the control device is further configured to reduce the amount of the flow of water to 66% or more and 90% or less of the reference amount in a case where the value X is 2.0 or more.

5. The water electrolysis system according to claim 4, wherein the control device is further configured to reduce the amount of the flow of water to 83.4% or more and 90% or less of the reference amount in a case where the value X is 2.0 or more and 3.985 or less.

* * * * *